US006243893B1

(12) United States Patent
Baldwin

(10) Patent No.: US 6,243,893 B1
(45) Date of Patent: Jun. 12, 2001

(54) PORTABLE WATER COOLED MATTRESS

(76) Inventor: Amanda G. Baldwin, 2451 Morning Glory La., Lawrenceville, GA (US) 30044

( * ) Notice: Subject to any disclaimer, the term of this patent is extended or adjusted under 35 U.S.C. 154(b) by 0 days.

(21) Appl. No.: 09/243,403

(22) Filed: Feb. 1, 1999

(51) Int. Cl.[7] ..... A47C 27/10
(52) U.S. Cl. ..... 5/422; 5/668; 5/655; 5/681
(58) Field of Search ..... 5/668, 422, 681, 5/679, 685, 655, 694, 710

(56) References Cited

U.S. PATENT DOCUMENTS

| | | | | |
|---|---|---|---|---|
| 3,766,579 | * | 10/1973 | Shields | 5/681 |
| 4,048,684 | | 9/1977 | Korner et al. | 5/370 |
| 4,121,310 | * | 10/1978 | Gorran | 5/679 |
| 4,186,457 | * | 2/1980 | Amelung | 5/681 X |
| 4,187,569 | | 2/1980 | Calleance | 5/451 |
| 4,292,701 | * | 10/1981 | Woychick | 5/681 |
| 4,638,518 | * | 1/1987 | Barbulla | 5/681 |
| 4,901,386 | | 2/1990 | Lane | 5/450 |
| 5,107,557 | | 4/1992 | Boyd | 5/451 |
| 5,311,623 | * | 5/1994 | Hendi | 5/685 |
| 5,448,788 | | 9/1995 | Wu | 5/421 |
| 5,490,295 | | 2/1996 | Boyd | 5/451 |

* cited by examiner

*Primary Examiner*—Michael F. Trettel
(74) *Attorney, Agent, or Firm*—Joseph N. Breaux

(57) ABSTRACT

A portable water cooled mattress for use with infants or the like comprising an air bladder lower level constructed of an air proof material and including an inflation and deflation opening valve. A water bladder layer is positioned on a top surface of the air bladder and includes a fill and empty spout valve while a pocket is formed between the water bladder and air bladder suitable for inserting either heating and/or cooling packs as desired. An insulating upper layer covers the water bladder preventing the child from becoming dampened from condensation.

3 Claims, 2 Drawing Sheets

PORTABLE WATER COOLED MATTRESS

DESCRIPTION

1. Technical Field

The present invention relates to devices and methods for mattresses and more particularly to devices and methods for a portable water cooled mattress that is particularly suitable for use with infants and comprises an air bladder lower layer constructed of an air-proof material with an inflation and deflation opening valve, a water bladder layer positioned on a top surface of the air bladder and including a fill and empty spout valve while a pocket is formed between the water and air bladder layers suitable for inserting heating or cooling packs and an insulating layer over the water bladder.

2. Background Art

There are numerous occasions when an infant must sleep in a climate which is either too cold or too hot and it is difficult to provide a comfortable sleeping arrangement. The present invention provides a mattress which the temperature may be adjusted by the user by inserting heating or cooling pads between a water and air layer. The water layer of the mattress provides a heat sink which will retain a temperature for a given period of time and provide comfort while a baby sleeps.

The prior art patent which are relevant are as follows:

Korner, et al, U.S. Pat. No. 4,048,684 discloses an infant waterbed for use in an incubator.

Calleance, U.S. Pat. No. 4,187,569 discloses a water mattress construction with an interior parametrial air chamber. This device is useful however it does not provide a means for altering and adjusting the temperature which provides comfort for a sleeping baby.

Lane, U.S. Pat. No. 4,901,386 discloses an air adjustable water mattress. This mattress is also useful, however it does not provide a means for easily adjusting the temperature by the insertion of heating or cooling packs between a water and air layers of the mattress.

Boyd, U.S. Pat. No. 5,107,557 discloses a waterbed mattress with air cushion. This invention is also useful however it does not include a pocket area as the present for inserting heating and cooling packs for the purposes of heating the water layer as the present invention.

Boyd, U.S. Pat. No. 5,490,295 discloses a water mattress and air mattress construction like the Boyd mattress describes above does not provide a pocket between air and water layers of the mattress for purposes of heating the water of the mattress and providing a comfortable temperature for the infant sleeping on the mattress surface.

Wu, U.S. Pat. No. 5,448,788 provides a thermo electric cooling, heating mattress which comprises a thermostatic control mattress including a water pump and external heating and cooling source. This device is also useful however it does not provide an easy to use mattress as the present which includes a pocket for inserting heating and cooling packs as desired to adjust the temperature for a sleeping baby.

As will be shown below the present invention provides a portable water cooled mattress for use with infants or the like comprising an air bladder lower layer constructed of an air proof material and including an inflation and deflation opening valve, a water bladder layer positioned on the top surface of the air bladder including a fill and empty spout valve and a pocket formed between the water and air bladder suitable for inserting heating or cooling packs while an insulating layer is provided over the water bladder.

GENERAL SUMMARY DISCUSSION OF INVENTION

It is thus an object of the invention to provide a Portable Water Cooled Mattress that provides a means for adjusting the temperature of an infant mattress so that the infant may sleep in comfort.

It is a further object of the invention to provide a Portable Water Cooled Mattress that comprises an air bladder lower layer constructed of an air-proof material and a water bladder positioned on a top surface of the air bladder wherein a pocket is formed between the air bladder and water bladder providing a location for inserting heating or cooling packs as desired in order to maintain a comfortable temperature of the water contained in the water bladder.

It is a still further object of the invention to provide a Portable Water Cooled Mattress that includes a heat sink comprising a volume of water placed within a water bladder positioned over an air bladder chamber wherein the temperature of the water is altered by the use of heating and/or cooling packs inserted in a pocket positioned between the air and water bladders.

Accordingly, a Portable Water Cooled Mattress is provided for use with infants or the like comprising an air bladder lower layer constructed of a durable air proof material and including an inflation and deflation valve opening, a water bladder level positioned on the top surface of the air bladder and further including a fill and empty spout valve while a pocket is formed between the water bladder and air bladder which is suitable for inserting heating and/or cooling packs as desired, the water bladder provides a means for creating a heat sink which provides an extended temperature control means and which provides an extended comfort time for the baby while an insulating upper layer covers the water bladder and is used to form a surface to lay the baby upon.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that in use one who desires to take an infant outdoors when it is either hot or cold would simply inflate the lower air layer of the portable water cooled mattress, fill the upper water level chamber with water, and insert either cooling or heating packs in the pocket formed between the water and air layers. The user would then place an infant onto the insulated surface for resting. A water resistant cover prevents moisture from condensation from dampening the infants clothing. When the user desires to transport the mattress the user would empty that water chamber by allowing the water to escape through the filling valve while the air chamber is similarly drained of air, the portable mattresses is then folded up compactly and easily stored or carried as desired.

Figure 1:
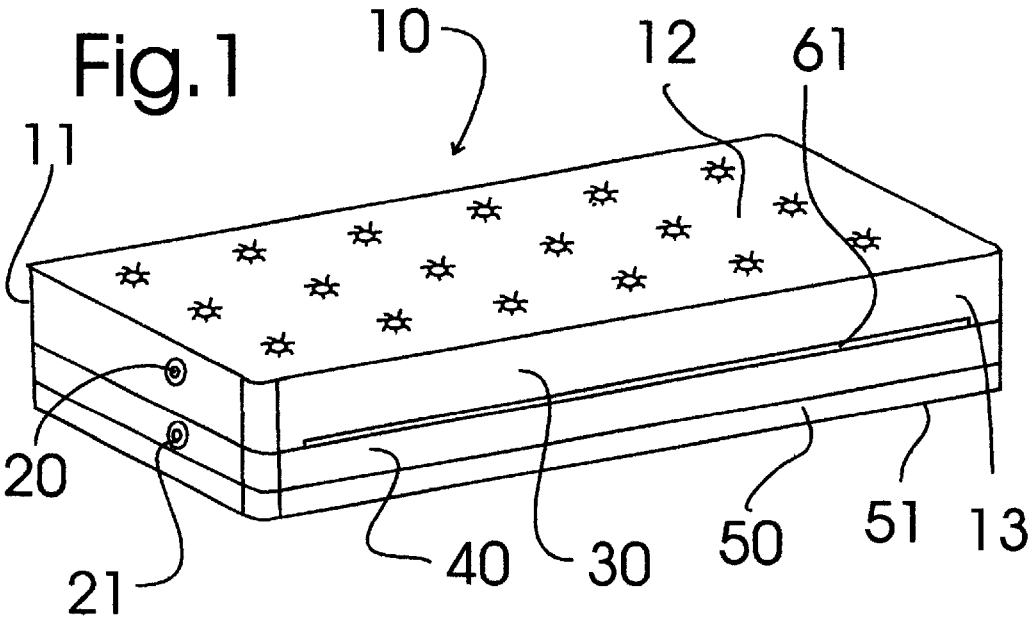
FIG. 1 is an isometric view of a portable water cool mattress indicating the layers of the mattress.
Figure 2:
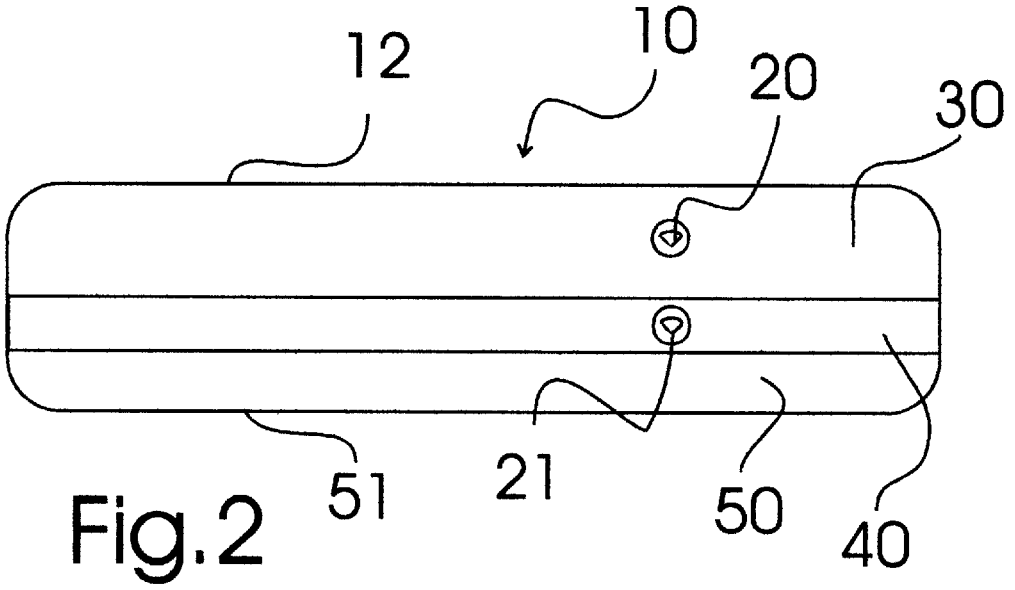
FIG. 2 is an in view of a mattress indicating the layers along with the filling spout valves for each of the air and water layers.

Referring to the figures in detail, FIG. 1 is an isometric view of the portable mattress 10 illustrating the placement of the filling valves 20 and 21 for the upper water chamber 30 and lower air chamber 40. A bottom durable layer 50 includes an outside surface material which is both waterproof and resistant to tearing 51. The portable mattress would preferably be fabricated of plastic material and be approximately thirty six inches square and about five inches thick. Both the air chamber 40 and water chamber 30 would each be approximately two and one half inches deep while the filling valves 20 and 21 are preferably located on an end 11 of the mattress 10. The top surface 12 of the mattress 10 includes a water resistant cloth or fabric mattress cover which provides comfort to the baby placed on the top surface 12.

A pocket area 60 is formed between the upper water layer 30 and air layer 40. The pocket area 60 includes an elongated entry flap 61 on each long side 13 of the mattress 10. The elongated entry flap 61 allows for a user to gain entry into the pocket area 60 and insert either heating or cooling packs 65 into the pocket area 60. The elongated entry flap 61 is preferably sealed using hook and pile securing means which extends the length of the elongated flap 61. The pocket area 60 is about one to about two inches tall allowing for the insertion of various types of heating and/or cooling packs. The heating and/or cooling packs 65 may be either freezing type cooling packs that contains freezable liquid, or heating packs. When the cooling pack is inserted into the pocket area 60 the cooling pack exchanges heat with the water and thereby reducing the temperature of the water and providing a comfortable sleeping mattress for the infant. Heating packs may also be placed into the pocket area 60 if necessary.

Figure 3:
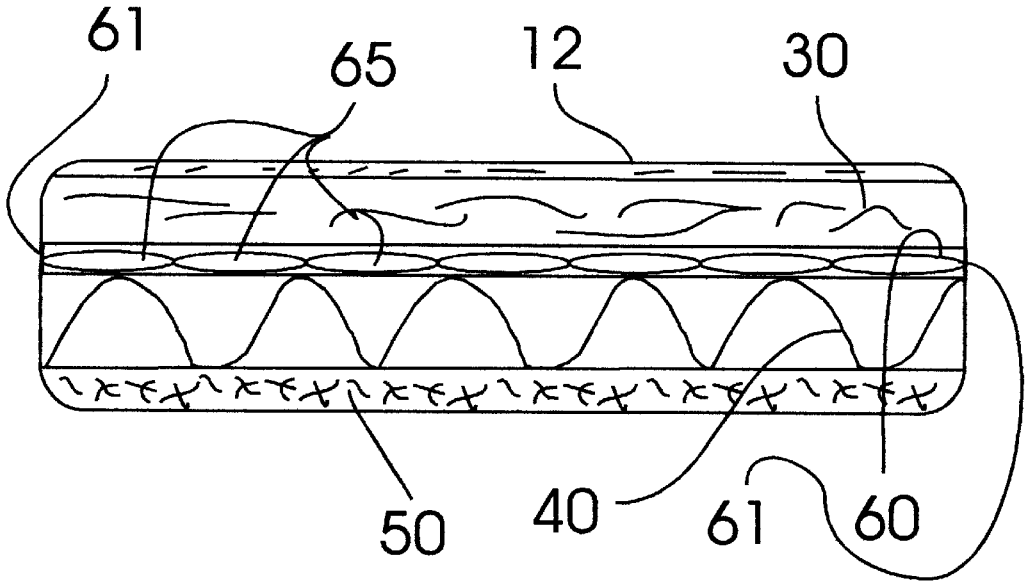
FIG. 3 is a cross sectional end view of the mattress illustrating all the layers of the mattress including the top insulated layer, the water layer, the cooling and heating pack pocket layer, the air layer and the base layer.

The air layer 40 of the mattress 10 is preferably baffled as illustrated in FIG. 3. The baffling prevents residual motion on the mattress and also adds rigidity to the mattress.

The bottom durable layer 50 of the mattress is preferably constructed of material which is resistant to tearing and also provides a cushioning layer. The top surface 12 is preferably waterproof so that moisture from the baby or moisture condensate on the mattress does not dampen the baby's clothes.

The valve members 20 and 21 are attached to an end 11 of the mattress 10 and are preferably valves that are quickly and easily filled and are drained by a user. The water valve 20 also includes a water hose connecting adapter which allows a water hose to be quickly attached to the mattress thereby providing a means for quickly filling the mattress with water. The air valve 21 includes a spout for easily placing in a mouth of a user and filling with air. The air valve 21 also includes a one way check valve which prevents the air from escaping when the user's mouth is removed from the filling valve 21.

It is noted that the embodiment of the Portable Water Cooled Mattress described herein in detail for examplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A Portable Water Cooled Mattress comprising:

a) a lower air chamber layer with internal baffles and an inflation deflation valve suitable for filling the chamber using the mouth of the user and which also includes a one way check valve which prevents the leakage of air from the air chamber when a user removes his or her mouth from the valve, further wherein the air chamber layer has an interior which is baffled with vertically positioned plastic sheet member which form internal meandering passageways that help reduce residual mattress movement, b) an upper water chamber positioned on a top of the air chamber layer the water chamber including a filling and draining valve which is adaptable to be connected to a water hose for filling the water chamber, c) a pocket area positioned between a top surface of the air chamber layer and a bottom surface of the water chamber, the pocket area having an elongated entry slot positioned along a longitudinal side of the mattress, the pocket area having a sealing flap which extends the length of the entry slot and which flap is sealed with hook and pile fasteners attached to the flap, and furthermore wherein cooling or heating packs are inserted into the pocket area which packs transfer heat from or to the water in the water chamber to serve as a source of either heating or cooling the water to a desired temperature, d) a mattress top insulating surface which prevents condensation from forming on a water chamber outer surface, and e) a durable tear resistant bottom surface attached to a bottom surface of the air chamber layer.

2. The Portable Water Cooled Mattress of claim 1, wherein the durable tear resistant bottom surface further comprises a cushioned layer between the durable tear resistant bottom surface and the bottom surface of the air chamber layer.

3. The Portable Water Cooled Mattress of claim 1, wherein elongated entry slots further comprise an elongated entry slot positioned on each longitudinal side of the mattress providing an entry slot on each side of the mattress.

* * * * *